US007922127B2

(12) United States Patent
Kumar et al.

(10) Patent No.: US 7,922,127 B2
(45) Date of Patent: Apr. 12, 2011

(54) SYSTEM AND METHOD FOR PACING A POWERED SYSTEM TRAVELING ALONG A ROUTE

(75) Inventors: Ajith Kuttannair Kumar, Erie, PA (US); Glenn Robert Shaffer, Erie, PA (US)

(73) Assignee: General Electric Company, Schenectady, NY (US)

( * ) Notice: Subject to any disclaimer, the term of this patent is extended or adjusted under 35 U.S.C. 154(b) by 134 days.

(21) Appl. No.: 12/191,758

(22) Filed: Aug. 14, 2008

(65) Prior Publication Data

US 2009/0266943 A1 Oct. 29, 2009

Related U.S. Application Data

(60) Provisional application No. 61/048,279, filed on Apr. 28, 2008.

(51) Int. Cl.
*B61L 21/00* (2006.01)

(52) U.S. Cl. ..... 246/28 R; 701/19

(58) Field of Classification Search ..... 246/28 R, 246/38 A, 2 S, 2 F, 4, 62, 167 R, 177, 180, 246/178, 182 R, 182 A, 182 B, 182 C, 186, 246/187 B, 187 R; 701/19
See application file for complete search history.

(56) References Cited

U.S. PATENT DOCUMENTS 6,314,345 B1 * 11/2001 Coombes ..... 701/19
6,401,015 B1 * 6/2002 Stewart et al. ..... 701/19
6,435,624 B1 * 8/2002 Kull et al. ..... 303/15
6,680,918 B1 * 1/2004 Haley ..... 370/282
6,789,004 B2 * 9/2004 Brousseau et al. ..... 701/19
6,925,366 B2 * 8/2005 Theurer et al. ..... 701/19
6,937,925 B2 * 8/2005 Smith ..... 701/20
6,957,131 B2 * 10/2005 Kane et al. ..... 701/19
6,985,803 B2 * 1/2006 Abdel-Malek et al. ..... 701/33
2004/0102877 A1 * 5/2004 Kane et al. ..... 701/19
2006/0261218 A1 * 11/2006 Mace et al. ..... 246/169 R
2007/0046220 A1 * 3/2007 Alton et al. ..... 318/52
2007/0078574 A1 * 4/2007 Davenport ..... 701/19
2007/0152107 A1 * 7/2007 LeFebvre et al. ..... 246/169 R
2007/0219681 A1 * 9/2007 Kumar et al. ..... 701/19
2007/0228223 A1 * 10/2007 Dittmar et al. ..... 246/28 R
2009/0173840 A1 * 7/2009 Brown et al. ..... 246/1 R
2009/0266943 A1 * 10/2009 Kumar et al. ..... 246/28 R
2009/0299555 A1 * 12/2009 Houpt et al. ..... 701/19
2010/0191395 A1 * 7/2010 Rosenkranz et al. ..... 701/19

* cited by examiner

*Primary Examiner* — S. Joseph Morano
*Assistant Examiner* — Jason C Smith
(74) *Attorney, Agent, or Firm* — Robert Wawrzyn, Esq.; Cian G. O'Brien, Esq.; Beusse Wolter Sanks Mora & Maire, P.A.

(57) ABSTRACT

A system is provided for pacing a powered system traveling along a route separated into a plurality of block regions. Each block region has a respective signal. The system includes a controller configured to receive a status of the signal in an adjacent block region to a current block region of the powered system. The controller is configured to determine a time duration between a change in the status of the signal in an adjacent block region. The controller is further configured to determine an expected status of the signal to be experienced by the powered system in the plurality of block regions, based upon the time duration and a route parameter of the plulality of block regions.

17 Claims, 4 Drawing Sheets

SYSTEM AND METHOD FOR PACING A POWERED SYSTEM TRAVELING ALONG A ROUTE

CROSS-REFERENCE TO RELATED APPLICATIONS

This application claims priority to U.S. Provisional Application No. 61/048,279 filed Apr. 28, 2008, and incorporated herein by reference in its entirety.

BACKGROUND OF THE INVENTION

This invention relates to a powered system, such as a train, an off-highway vehicle, a marine vessel, a transport vehicle, and/or an agriculture vehicle, and more particularly to a system, method, and computer software code for controlling a powered system.

Some powered systems such as, but not limited to, off-highway vehicles, marine diesel powered propulsion plants, transport vehicles such as transport buses, agricultural vehicles, and rail vehicle systems or trains, are powered by one or more diesel power units, or diesel-fueled power generating units. With respect to rail vehicle systems, a diesel power unit is usually a part of at least one locomotive powered by at least one diesel internal combustion engine, and with the locomotive being part of a train that further includes a plurality of rail cars, such as freight cars. Usually more than one locomotive is provided, wherein a group of locomotives is commonly referred to as a locomotive "consist." Locomotives are complex systems with numerous subsystems, with each subsystem being interdependent on other subsystems.

Rail vehicles, such as locomotives, for example, travel along a railroad which is divided into a number of block regions. Each block region includes a switch and a light signal positioned adjacent to the switch. When a locomotive occupies a block region, the light signal in the previous block region will have a red status so that an operator of a locomotive in the previous block region will stop the locomotive in the previous block region. Additionally, the light signal in the second previous block region will have a yellow status so that an operator of a locomotive in the second previous block region will reduce the speed of the locomotive in the second previous block region. Additionally, a light signal may have a flashing yellow status in a block region which is ahead of a block region having a light signal with a yellow status, for example. For example, an operator may observe a green light status, a yellow light status, a flashing yellow light status, and a red light status in consecutive block regions, for example. As appreciated by one of skill in the art, this light signaling arrangement is designed to ensure the safety of those locomotives traveling through the block regions of the railroad.

In conventional locomotive systems, a remote dispatch center communicates minimal information to a locomotive operator, such as an authorization for the locomotive to travel to a specific mile posting on the railroad, for example. Additionally, an operator of a locomotive observes the status of the light signals in each block region when determining the locomotive parameters, such as an engine notch, for example. Thus, operators of conventional locomotive systems propel the train at or near speed limit and stop or reduce the speed, depending on the observed status of the signals in each block region, since the operator is not aware when the states of light signals in upcoming block regions are likely to change.

BRIEF DESCRIPTION OF THE INVENTION

One embodiment of the present invention provides a system for pacing a powered system traveling along a route separated into a plurality of block regions. Each block region has a respective signal. The system includes a controller configured to receive a status of the signal in a block region adjacent to a current block region of the powered system. The controller is configured to determine a time duration relating to a change in the status of the signal in the adjacent block region (e.g., the time duration may be the time between when the signal changes to a first state and when the signal changes to a second state). The controller is also configured to determine an expected status of the signal(s) to be experienced by the powered system in the plurality of block regions, based upon the time duration and one or more route parameters of the plurality of block regions. ("Route parameter" refers to a characteristic of a block region, such as length or grade.)

In this manner, in one embodiment, the controller is provided with (or is configured to defer/determine) the expected respective status of each of one or more signals that the locomotive will encounter at various times along the railroad. With this information, the controller is able to selectively adjust the locomotive parameters to operate the locomotive more efficiently, such as minimizing the amount of fuel consumed, for example.

Another embodiment of the present invention provides a system for pacing at least one powered system traveling along a route separated into a plurality of block regions. Each block region has a respective signal. The system includes a control center positioned remotely from the route. The control center is in wireless communication with the at least one powered system. The control center includes a controller to determine an arrival time range for the at least one powered system to travel to a respective block region, such that a performance characteristic of the powered system is maximized. The at least one powered system includes a respective controller configured to receive the arrival time range for the powered system to travel to a respective block region.

Another embodiment of the present invention provides a method for pacing a powered system traveling along a route separated into a plurality of block regions. Each block region has a respective signal. The method includes storing one or more route parameters of the plurality of block regions. The method further includes measuring a time duration between a change in the status of the signal in a block region adjacent to a current block region of the powered system. The method further includes determining an expected status of the signal to be experienced by the powered system in the adjacent block region, based upon the time duration and the stored route parameter of the adjacent block region.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered to be limiting of its scope, exemplary embodiments of the invention will be described and explained with additional specificity and detail through the use of the accompanying drawings in which.

DETAILED DESCRIPTION OF THE INVENTION

Figure 1:
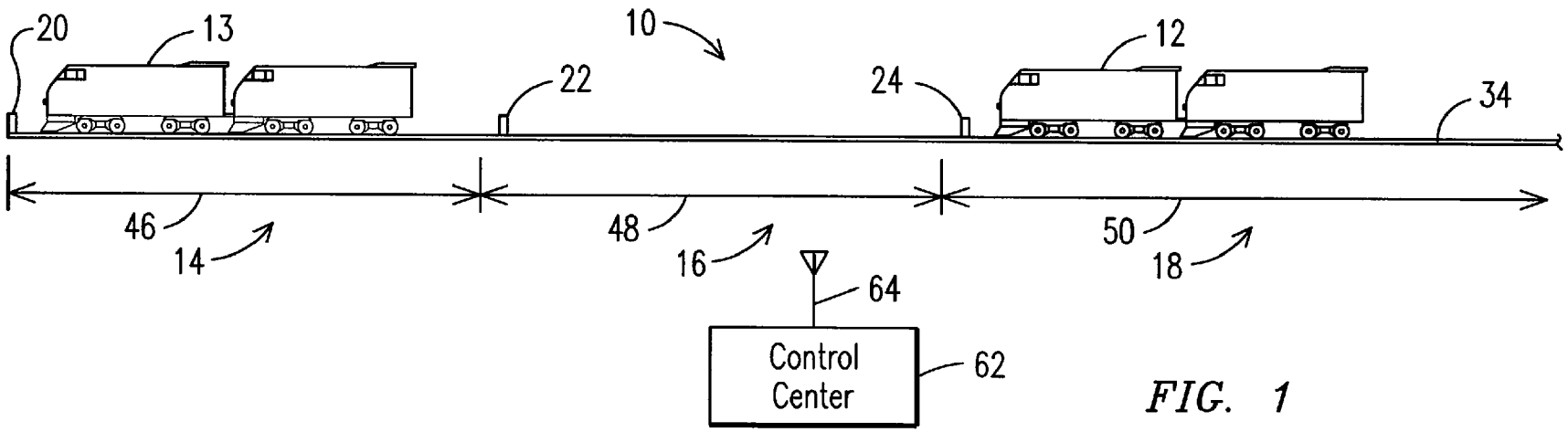
FIG. 1 illustrates a side plan view of an exemplary embodiment of a system for pacing a powered system traveling along a route separated into a plurality of block regions in accordance with the present invention.

Reference will now be made in detail to the embodiments consistent with the invention, examples of which are illustrated in the accompanying drawings. Wherever possible, the same reference numerals used throughout the drawings refer to the same or like parts.

Though exemplary embodiments of the present invention are described with respect to rail vehicles, or railway transportation systems, specifically trains and locomotives having diesel engines, exemplary embodiments of the invention are also applicable for use with other moving powered systems that travel along a route, such as but not limited to off-highway vehicles, marine vessels, and agricultural vehicles, transport buses, and other vehicles, each which may use at least one diesel engine, or diesel internal combustion engine, or other engine. Towards this end, when discussing a specified mission, this includes a task or requirement to be performed by the powered system.

Therefore, with respect to railway vehicles, marine vessels, transport vehicles, agricultural vehicles, or off-highway vehicle applications, this may refer to the movement of the powered system from a present location to a destination. An operating condition of the powered system may include one or more of speed, load, fueling value, timing, etc. Furthermore, though diesel powered systems are disclosed, those skilled in the art will readily recognize that embodiment of the invention may also be utilized with non-diesel powered systems, such as but not limited to natural gas powered systems, gasoline powered systems, bio-diesel powered systems, etc.

Furthermore, as disclosed herein such non-diesel powered systems, as well as diesel powered systems, may include multiple engines, other power sources, and/or additional power sources, such as, but not limited to, battery sources, voltage sources (such as but not limited to capacitors), chemical sources, pressure based sources (such as but not limited to spring and/or hydraulic expansion), current sources (such as but not limited to inductors), inertial sources (such as but not limited to flywheel devices), gravitational-based power sources, and/or thermal-based power sources.

In one exemplary example involving marine vessels, a plurality of tugs may be operating together where all are moving the same larger vessel, and where each tug is linked in time to accomplish the mission of moving the larger vessel. In another example, a single marine vessel may have a plurality of engines. Off-highway vehicle (OHV) systems may involve a fleet of vehicles (e.g., mining trucks or other mining equipment) that have a shared mission to move earth, from location A to location B, where each OHV is linked in time to accomplish the mission. In one example involving locomotive vehicles, a plurality of diesel powered systems may be operating together where all are moving the same larger load, and where each system is linked in time to accomplish the mission of moving the larger load. In another exemplary embodiment a locomotive vehicle may have more than one diesel powered system.

FIG. 1 illustrates an exemplary embodiment of a system 10 for pacing a powered system (e.g., controlling the velocity or other rate of operation of the powered system, or otherwise controlling the pace of the powered system) such as a first locomotive 12 traveling along a route. In the case of a locomotive 12, the route is typically a railroad 34 separated into block regions 14,16,18. A leading locomotive 13 is also traveling along the railroad 34, and is positioned ahead of the first locomotive 12. Each block region 14,16,18 has a respective light signal 20,22,24, which indicates a status to a locomotive in the respective block region 14,16,18 or approaching the respective block region. The status of the light signal 20 would depend on whether a locomotive occupied one of the next two block regions following the block region 14. For example, if a locomotive occupied the first block region after the block region 14, the light signal 20 would be red. In another example, if a locomotive occupied the second block region after the block region 14, the light signal 20 would be yellow. In the example shown in FIG. 1, the status of the light signal 22 is red, since the leading locomotive 13 occupies the block region 14 after the block region 16, and would instruct the operator of a locomotive in the block region 16 to stop. The status of the light signal 24 is yellow, since the leading locomotive 13 occupies the block region 14 which is two block regions ahead of the block region 18, and would instruct the operator of the first locomotive 12 to slow down. A control center 62 is positioned remotely to the railroad 34 and is configured to transmit the status of the signals 20,22,24 using a transceiver 64 to the locomotive 12, so that a controller 26 (FIG. 2) can utilize this status information of the signals 20,22,24 in the operation of the locomotive 12. Additionally, the status of the signals 20,22,24 may be transmitted to the locomotive 12 from the signals 20,22,24 themselves or may be manually inputted into the controller 26 by the operator, for example.

Figure 2:
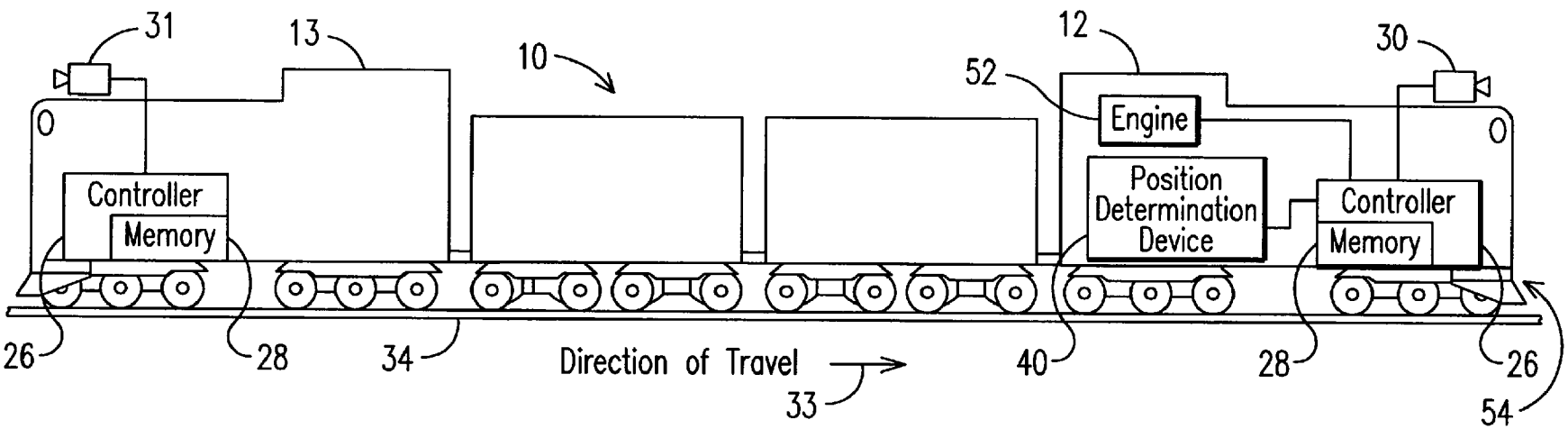
FIG. 2 illustrates a side plan view of an exemplary embodiment of a system for pacing a powered system traveling along a route separated into a plurality of block regions in accordance with the present invention.
Figure 3:
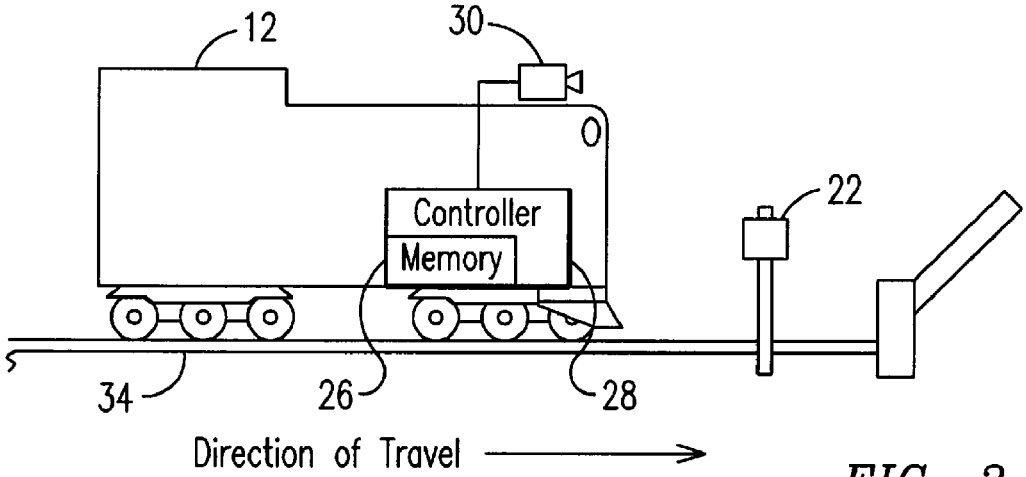
FIG. 3 illustrates a partial side plan view of the exemplary embodiment of a system for pacing a powered system traveling along a route separated into a plurality of block regions illustrated in FIG. 2.

As illustrated in the exemplary embodiment of FIG. 2, the system 10 includes a controller 26 positioned on the locomotive 12. The controller 26 includes a memory 28 which stores a parameter of the railroad 34 along each of the block regions 14,16,18, such as a respective length 46,48,50 (FIG. 1) of the block regions 14,16,18, or a grade of the block regions 14,16,18, for example. (More than one such parameter may be stored for each block region.) Additionally, a pair of video cameras 30,31 are positioned on the locomotive 12, and are respectively oriented in the same and opposite as the direction of travel 33. The pair of video cameras 30,31 are respectively coupled to the controller 26. The forward-oriented camera 30 is positioned and/or aligned to monitor the status of the signals 20,22 in adjacent block regions 14,16 ahead of the current block region 18 of the locomotive 12. Additionally, the rearward-oriented camera 31 may be positioned and/or aligned to monitor the status of the signals (not shown) in adjacent block regions (not shown) behind the current block region 18. Although FIG. 2 illustrates a locomotive 12 having a forward and rearward oriented camera 30,31, the locomotive may only have a forward oriented camera 30, or may have no cameras, in which case an operator of the locomotive 12 monitors the status of the signals 20,22 in adjacent block regions 14,16 ahead of the current block region 18 of the locomotive 12. Upon monitoring the status of these signals 20,22, the operator inputs the status of the signals 20,22 into the controller 26 using a keypad. Additionally, as discussed above, the control center 62 may transmit the statuses of the signals 20,22,24 to the controller 26 through the transceiver 64 of the control center 62.

Upon receiving the status of each of the signals 20,22 of the adjacent block regions 14,16 ahead of the current block region 18, the controller 26 measures a time duration between a change in the status of a signal 20,22 in an adjacent block region 14,16. For example, once the leading locomotive 13 enters the adjacent block region 14, the signal 22 will change its status from a green status to a red status. Additionally, once the leading locomotive 13 leaves the adjacent block region 14, the signal 22 will change its status from a red status to a yellow status. Thus, the controller 26 will receive these changes in status of the signal 22 as the leading locomotive 13 respectively enters and exits the adjacent block region 14. The controller 26 subsequently determines the time duration between the initial change in status of the signal 22, when the leading locomotive 13 entered the adjacent block region 14, and the subsequent change in status of the signal 22, when the leading locomotive 13 exited the adjacent block region 14. Therefore, the controller knows the amount of time required for the leading locomotive 13 to traverse the block region 14. In another example, the controller 26 may determine the time duration between the change in the status of the signal 22 from a green status to a red status, when the leading locomotive 13 enters the adjacent block region 14 and the change in the status of the signal 20 from a green status to a red status, when the leading locomotive 13 exits the adjacent block region 14.

As illustrated in FIG. 2, the system 10 further includes a position determination device 40 on the locomotive 12 to provide location information of the locomotive 12 along the railroad 34 to the controller 26. Upon calculating the time duration required from the leading locomotive 13 to pass through the adjacent block region 14, the controller 26 determines an estimated speed of the leading locomotive 13 through the adjacent block region 14, based on the time duration and a length 46 of the adjacent block region 14 from the memory 28. Additionally, the controller 26 may utilize a stored parameter of the railroad 34 from the memory 28, such as the grade of the railroad 34 through the adjacent block region 14, for example, in calculating the estimated speed.

In an exemplary embodiment, the controller 26 determines a characteristic of the leading locomotive 13, such as the type, the weight, or the length of the locomotive, for example, based upon the estimated speed of the leading locomotive 13 in the adjacent block region 14. The memory 28 of the controller 26 may have a pre-stored table with the typical characteristics for a locomotive based upon a typical speed, for example, and the controller 26 may determine the characteristics of the leading locomotive 13 from the memory 28 based on the estimated speed through the adjacent block region 14, for example. Once the controller 26 has determined the characteristics of the leading locomotive 13, the controller 26 determines an expected movement of the leading locomotive 13 through the block regions subsequent to the adjacent block region 14, based on the characteristics of the leading locomotive 13, and the pre-stored parameters of the block regions, including length and grade, for example, from the memory 28, for example. For example, if the controller 26 estimates a speed of 20 mph of the leading locomotive 13 through the adjacent block region 14, and determines that the characteristics of the leading locomotive 13 are similar to a coal train, the controller 26 may determine that the leading locomotive 13 will travel through the next three block regions in 30 minutes, 20 minutes, and 1 hour, respectively, based on the length and grade of those block regions stored in the memory 28, for example.

In an exemplary embodiment, upon determining the expected movement of the leading locomotive 13 through the block regions subsequent to the adjacent block region 14, the controller 26 determines an expected status of the signals to be experienced by the locomotive 12 in these respective block regions. In the example above that the leading locomotive 13 will travel through the next three block regions in 30 minutes, 20 minutes and 1 hour, respectively, the controller 26 determines that the signal 20 will not change from red to yellow for the 30 minutes after the leading locomotive 13 enters the first block region after the adjacent block region 14. Additionally, the controller 26 will determine that the first signal after the signal 20 will not change from red to yellow for 1 hour and 50 minutes after the leading locomotive 13 enters the first block region after the adjacent block region 14.

As illustrated in FIG. 2, the controller 26 is coupled to an engine 52 and a braking system 54 of the locomotive 12. The controller 26 selectively modifies a notch or other throttle or propulsion setting of the engine 52 and/or selectively activates the braking system 54, based on the expected status of the signals in block regions after the adjacent block region 14, so as to minimize a total amount of fuel consumed by the locomotive 12 in the block regions. In the above example, since the first signal after the signal 20 will not change from red to yellow for 1 hour and 50 minutes after the leading locomotive 13 enters the first block region after the adjacent block region 14, the controller 26 may modify the engine 52 notch to zero, instead of activating the brakes, and coast through the adjacent block region 14 to conserve fuel.

In an exemplary embodiment, the controller 26 is in an automatic mode and prior to commencing the trip on the railroad 34, determines a predetermined notch of the engine 52 and/or a predetermined level of the braking system 54 at incremental locations along the railroad 34. (Here, "incremental" refers to successive locations, the distance between which may vary based on the application in question.) Based on the expected status of the signals in the block regions after the adjacent block region 14, the controller 26 may modify the predetermined notch of the engine 52 and/or the predetermined level of the braking system 54 at the incremental locations along the railroad 34.

Figure 4:
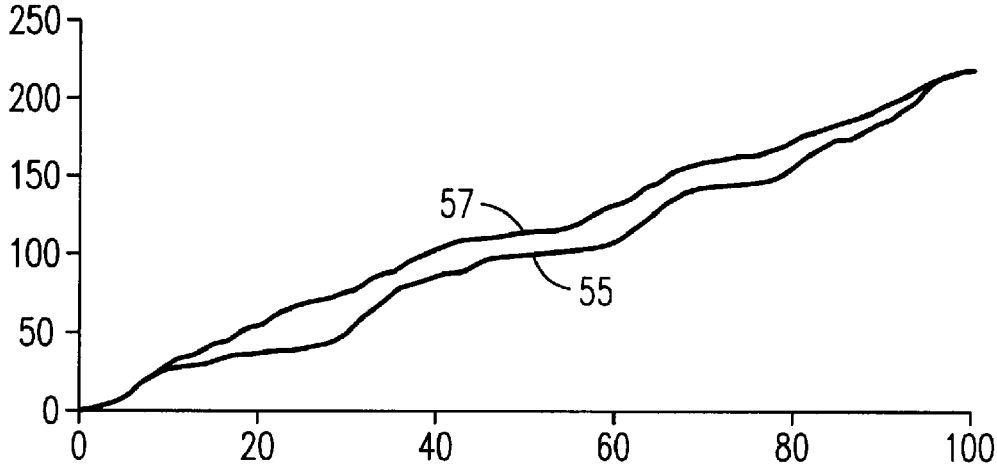
FIG. 4 illustrates a plot of an exemplary embodiment of the conventional plan and a modified plan of the projected time versus distance of a locomotive traveling along a route.
Figure 5:
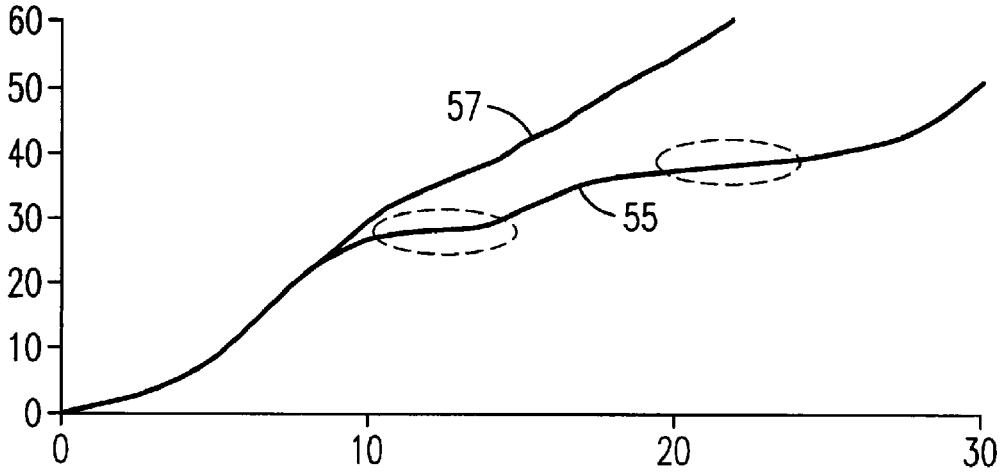
FIG. 5 illustrates a partial plot of an exemplary embodiment of the modified plan illustrated in FIG. 4.

FIG. 4 illustrates an exemplary plot of the distance in miles (horizontal axis) versus the time in minutes (vertical axis) of the locomotive 12 while traveling through the block regions over the railroad 34. Based on the expected status of the signals in the block regions after the adjacent block region 14, the controller 26 determined to modify the original plan 55 to a modified plan 57 in which the controller 26 reduced the notch of the engine 52 and/or activated the braking system 54 before reaching the mile markers 13, 20, 50 and 75. For example, the controller 26 may have determined that a signal positioned at mile markers 13, 20, 50 and 75 would have a red or a yellow status under the original plan 55, but would each have a green status under the modified plan 57. In the exemplary embodiment of FIG. 5, which illustrates a more-detailed view of FIG. 4 from the mile markers 0-30, the original plan 55 involved a relatively high speed to mile markers 13 and 20, followed by a sharp reduction in speed. The modified plan 57, conversely, involves a consistent locomotive 12 speed throughout the mile markers 0-30, resulting in increased fuel efficiency, for example.

Figure 6:
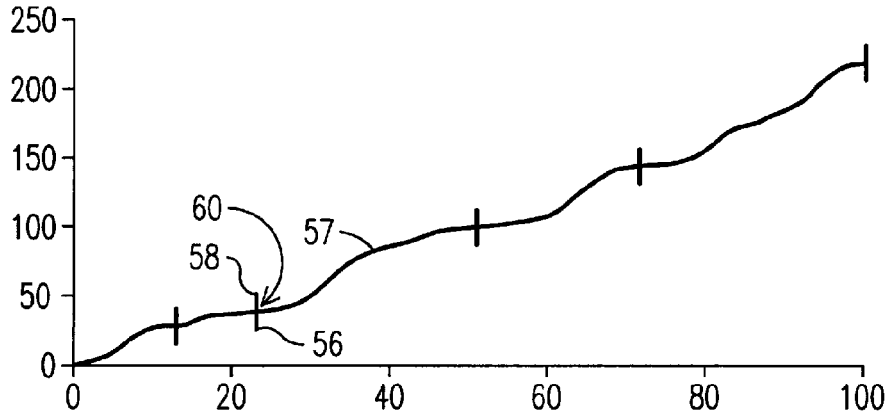
FIG. 6 illustrates a plot of an exemplary embodiment of a modified plan of a projected time versus distance of a locomotive traveling along a route.

As illustrated in the exemplary embodiment of FIG. 6, the controller 26 may determine an earliest arrival time 56 and a latest arrival time 58 at each block region, which is based upon the expected status of the signal in the block regions. The earliest arrival time at a block region is determined to avoid blocking the railroad 34 from following locomotives, while the latest arrival time at a block region is determined to avoid running into or colliding with the leading locomotive 13. The controller 26 may selectively modify the notch of the engine 52 and/or the braking system 54 such that the locomotive 12 arrives at each block region within an arrival time range 60 defined by the earliest arrival time 56 and the latest arrival time 58. In an exemplary embodiment, the earliest arrival time 56 for a block region may be based on a change in the status of the signal in the block region from red to yellow, for example. In another exemplary embodiment, the latest arrival time 58 for a block region may be based on a change in the status of the signal in two preceding blocks and the position of a trailing locomotive, for example.

In the above exemplary embodiment, the controller 26 determined a characteristic of the leading locomotive 13 by estimating a speed of the locomotive through an adjacent block region 14. However, other methods may be employed by the system 10 to determine a characteristic of the leading locomotive 13 and subsequently determine an expected status of the signals within block regions along the railroad 34. The memory 28 may have pre-stored characteristics of the leading locomotive 13 which travels on the railroad 34 in the adjacent block region 14. The controller 26 determines an expected movement of the leading locomotive 13 in subsequent block regions to the adjacent block region 14 based upon the pre-stored leading locomotive 13 characteristic and/or the route parameter of the subsequent block regions. The controller 26 determines the expected status of the signal to be experienced by the locomotive 12 in the block regions, based on the expected movement of the leading locomotive 13 in the subsequent block regions.

Figure 7:
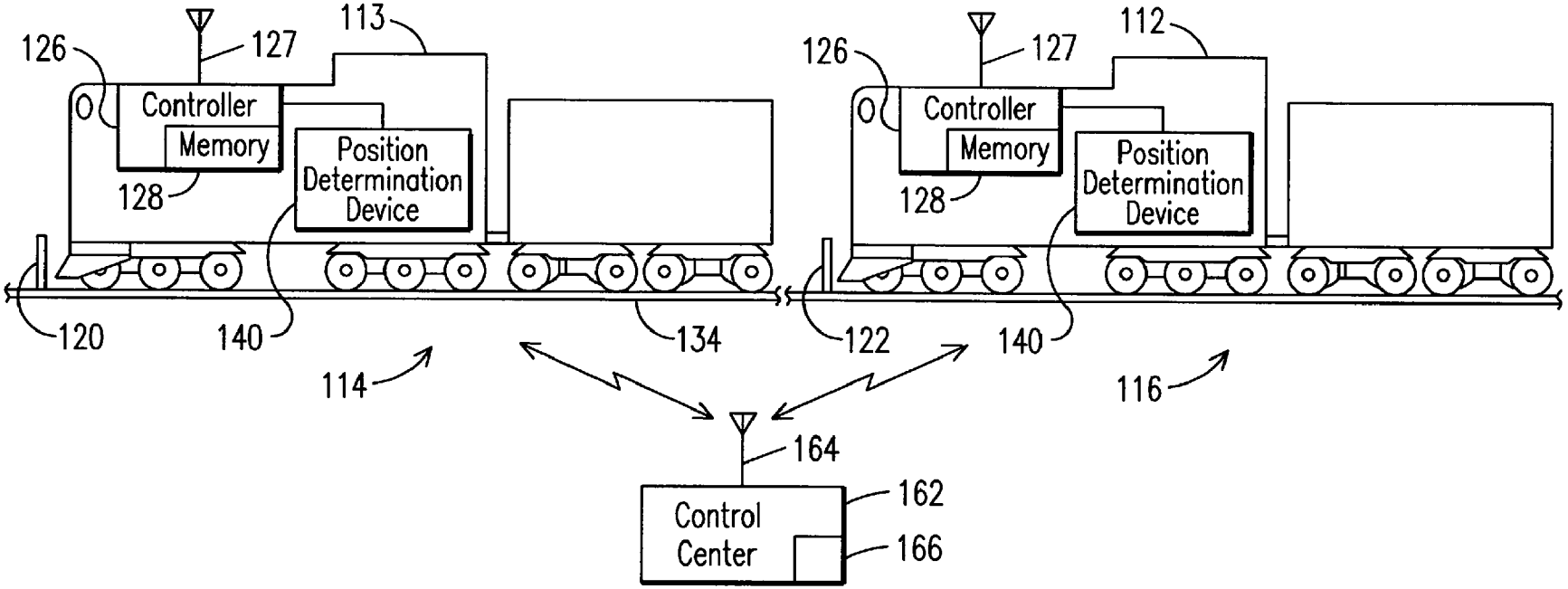
FIG. 7 illustrates a side plan view of an exemplary embodiment of a system for pacing a powered system traveling along a route separated into a plurality of block regions in accordance with the present invention.

FIG. 7 illustrates an exemplary embodiment of a system 110 for pacing a pair of locomotives 112,113 traveling along a railroad 134 separated into block regions 114, 116. Although FIG. 7 illustrates a pair of locomotives 112,113, the system 110 may be implemented with a single locomotive or more than two locomotives, for example. Each block region 114,116 has a respective signal 120, 122. The system 110 includes a control center 162 positioned remotely from the railroad 134. The control center 162 has a transceiver 164 in communication with a respective transceiver 127 coupled to the locomotives 112,113 or to the track or the track signaling system.

Figure 8:
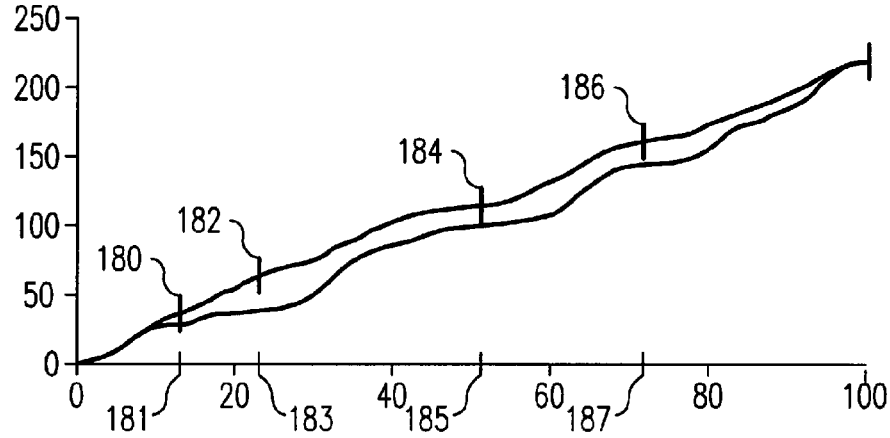
FIG. 8 illustrates a plot of an exemplary embodiment of a modified plan of a projected time versus distance of a locomotive traveling along a route.

The locomotives 112,113 each include a controller 126 coupled to the transceiver 127. The controller 126 of each locomotive 112,113 receives an arrival time range 180,182 (see FIG. 8) for a plurality of block regions 185,187 (at approximately mile post 50 and 70) along the railroad 134 from the transceiver 164. Thus, as long as the locomotive 112 arrives at the block region 185 within the time range 180, and arrives at the block region 187 within the time range 182, the locomotive 112 will experience one of many performance advantages, such as a minimal amount of fuel consumed, a minimum amount of energy consumed, or a consistent status of green signals through the block regions 185,187, for example. In the exemplary embodiment of FIG. 8, the arrival time range 184 for the locomotive 112 to travel through the block region 185 is approximately 100-120 minutes from the commencement of the trip, and thus the locomotive 112 would need to arrive at the block region 185 in that time range in order to take advantage of a performance advantage listed above, for example. Additionally, in this example, if the locomotive 112 were to arrive at the block region 185 just prior to 100 minutes from the commencement of the trip (i.e., at the earliest arrival time), the signal in the block region 185 may have a yellow status, but if the locomotive 112 were to arrive at the block region 185 shortly after 100 minutes (e.g., 110 minutes) from the commencement of the trip, the signal in the block region 185 would have a green status, for example. The controller 126 has a memory 128 to store a parameter of the locomotive 112,113 and a parameter of the railroad 134. The locomotives 112,113 further include a position determination device 140 to provide location information of the locomotive 112,113 to the controller 126. The locomotives 112,113 respectively transmit the pre-stored locomotive parameter, the pre-stored railroad 134 parameter, and the location information to the control center 162. The control center 162 utilizes the locomotive parameter, railroad parameter and location information from the locomotive 112 to determine an estimated arrival time of the locomotive 112 at the block regions 185,187. The control center 162 includes a controller 166 to determine the arrival time ranges 180,182 for the plurality of block regions 181,183 along the railroad 134 such that the locomotives 112,113 collectively consume a minimal amount of fuel while traveling along the route. As illustrated in the exemplary embodiment of FIG. 8, the controller 126 of the locomotive 112 may determine an arrival time range 180, 182 at a pair of block regions 181,183 (at approximately mile post 15 and 25), using the local pacing methods discussed in the above embodiments of FIGS. 1-6, based on determining an expected status of signals within the pair of block regions 181,183 (e.g., by estimating the characteristics of a leading locomotive). Thus, the system 110 may involve an arrival time range 180,182 for some block regions 181,183 determined by the local pacing methods of FIGS. 1-6 and an arrival time range(s) 184,186 provided by the control center 162 for other block regions 185,187, such that the controller 126 can plan accordingly in order to minimize the total amount of fuel consumed and/or the total amount of energy consumed, for example. The arrival time windows could be multiple (for red/flashing yellow/yellow/green status) or could involve considerations of both time and speed to traverse through a block region.

Figure 9:
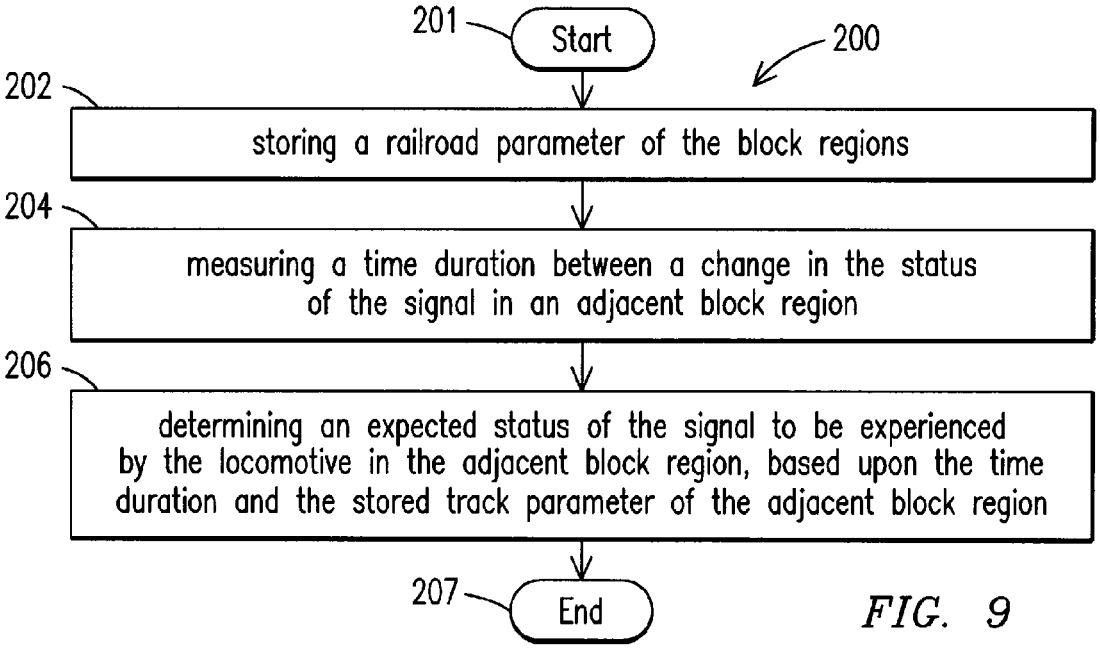
FIG. 9 illustrates a flow chart of an exemplary embodiment of a method for pacing a locomotive traveling along a railroad separated into a plurality of block regions in accordance with the present invention.

FIG. 9 illustrates an exemplary embodiment of a method 200 for pacing a locomotive 12 traveling along a railroad 34 separated into a plurality of block regions 14,16,18. Each block region 14,16,18 has a respective signal 20,22,24. The method 200 begins at 201 by storing 202 a railroad 34 parameter (or multiple parameters) of each of the block regions 14,16,18. The method 200 further includes measuring 204 a time duration between a change in the status of the signal 22 in an adjacent block region 16 to a current block region 18 of the locomotive 12. The method 200 further includes determining 206 an expected status of the signal to be experienced by the locomotive 12 in the adjacent block region, based upon the time duration and the stored track parameter of the adjacent block region, before ending at 207.

While the invention has been described with reference to various exemplary embodiments, it will be understood by those skilled in the art that various changes, omissions and/or additions may be made and equivalents may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. A system for pacing a powered system traveling along a route separated into a plurality of block regions, each block region having a respective light signal positioned adjacent to the route within the respective block region, the system comprising:

a controller configured to receive a status of the light signal positioned in an adjacent block region along the route subsequent to a current block region in which the powered system is positioned; said controller being configured to determine a time duration relating to a change in the status of the signal in the adjacent block region; and said controller being configured to determine an expected status of each of one or more of the signals to be experienced by the powered system in the plurality of block regions subsequent to the current block region, based upon the time duration and at least one route parameter of one or more of the plurality of block regions.

2. The system of claim 1, wherein said powered system is one of an off-highway vehicle, a marine propulsion vehicle, or a rail vehicle.

3. The system of claim 1, wherein the controller includes a memory configured to store the at least one route parameter of the one or more of the plurality of block regions.

4. The system of claim 3, wherein said determination of the expected status of each of the one or more signals in the plurality of block regions includes a determination of an expected movement of the leading powered system on the route in said adjacent block region.

5. The system of claim 4, wherein said determination of the expected movement of the leading powered system on the route is based upon:

a first change in the status of the signal in the adjacent block region being indicative of the leading powered system entering said adjacent block region; and a second change in the status of the signal in the adjacent block region being indicative of the leading powered system leaving said adjacent block region;

wherein the time duration relating to a change in status is based on the time difference between the first change and the second change in the status.

6. The system of claim 5, wherein said controller is configured to determine an estimated speed of the leading powered system in the adjacent block region based upon the time duration and a route parameter of the adjacent block region stored in the memory.

7. The system of claim 6, wherein said route parameter of the adjacent block region is one of a length of the adjacent block region, or a grade of the adjacent block region.

8. The system of claim 6, wherein said controller is configured to determine a characteristic of the leading powered system based upon said estimated speed of the leading powered system in the adjacent block region; and said controller is configured to further determine an expected movement of the leading powered system in a plurality of block regions subsequent to the adjacent block region, based upon said characteristic of the leading powered system.

9. The system of claim 8, wherein said controller is configured to determine the expected status of each of the one or more signals to be experienced by the powered system in the plurality of block regions, based on the expected movement of the leading powered system in the plurality of block regions subsequent to the adjacent block region.

10. The system of claim 3, wherein said memory is further configured to store a characteristic of the leading powered system traveling on the route in said adjacent block region; and said controller is configured to determine an expected movement of the leading powered system in a plurality of block regions subsequent to the adjacent block region based upon said stored characteristic of the leading powered system and one or more of the at least one route parameter of said plurality of block regions.

11. The system of claim 10, wherein said controller is configured to determine an expected status of each of the one or more signals to be experienced by the powered system in the plurality of block regions, based on the expected movement of the leading powered system in the plurality of block regions.

12. The system of claim 1, wherein said controller receives the status of the signal in the adjacent block region from a camera positioned on the powered system, an input provided by an operator of the powered system, and/or a communication received from a remote center.

13. A system for pacing a powered system traveling along a route separated into a plurality of block regions, each block region having a respective signal, the system comprising:

a controller configured to receive a status of the signal in a block region adjacent to a current block region of the powered system; said controller being configured to determine a time duration relating to a change in the status of the signal in the adjacent block region; and said controller being configured to determine an expected status of each of one or more of the signals to be experienced by the powered system in the plurality of block regions, based upon the time duration and at least one route parameter of one or more of the plurality of block regions;

wherein said controller is coupled to an engine and a braking system of the powered system, and said controller is configured to selectively modify one of a power output of the engine and a level of the braking system, based on the expected status of each of one or more of the signals in the plurality of block regions, so to minimize a total amount of fuel consumed by the powered system while traveling through the plurality of block regions.

14. The system of claim 13, wherein said controller is in an automatic mode to determine a predetermined power output of the engine and/or a predetermined level of the braking system at incremental locations along the route prior to the commencement of a trip along the route; and said controller is configured to modify said predetermined power output and/or said predetermined level of the braking system based upon the expected status of each of the one or more signals in the plurality of block regions.

15. A system for pacing a powered system traveling along a route separated into a plurality of block regions, each block region having a respective signal, the system comprising:

a controller configured to receive a status of the signal in a block region adjacent to a current block region of the powered system; said controller being configured to determine a time duration relating to a change in the status of the signal in the adjacent block region; and said controller being configured to determine an expected status of each of one or more of the signals to be experienced by the powered system in the plurality of block regions, based upon the time duration and at least one route parameter of one or more of the plurality of block regions;

wherein the controller includes a memory configured to store the at least one route parameter of the one or more of the plurality of block regions;

wherein said determination of the expected status of each of the one or more signals in the plurality of block regions includes a determination of an expected movement of a leading powered system on the route in said adjacent block region, based upon;

a first change in the status of the signal in the adjacent block region being indicative of the leading powered system entering said adjacent block region, and a second change in the status of the signal in the adjacent block region being indicative of the leading powered system leaving said adjacent block region, wherein the time duration relating to a change in status is based on the time difference between the first change and the second change in the status;

wherein said controller is configured to determine an estimated speed of the leading powered system in the adjacent block region based upon the time duration and a route parameter of the adjacent block region stored in the memory;

wherein said controller is configured to determine a characteristic of the leading powered system based upon said estimated speed of the leading powered system in the adjacent block region; and said controller is configured to further determine an expected movement of the leading powered system in a plurality of block regions subsequent to the adjacent block region, based upon said characteristic of the leading powered system;

wherein said controller is configured to determine the expected status of each of the one or more signals to be experienced by the powered system in the plurality of block regions, based on the expected movement of the leading powered system in the plurality of block regions subsequent to the adjacent block region;

and wherein said controller is configured to determine an earliest arrival time and a latest arrival time at each of the plurality of block regions based upon the expected status of each of the one or more signals in the plurality of block regions; and said controller is coupled to an engine and a braking system to selectively modify a power output of the engine and/or a level of the braking system such that said powered system arrives at each block region within an arrival time range defined by said earliest arrival time and said latest arrival time.

16. A system for pacing a powered system traveling along a route separated into a plurality of block regions, each block region having a respective signal, the system comprising:

a controller configured to receive a status of the signal in a block region adjacent to a current block region of the powered system; said controller being configured to determine a time duration relating to a change in the status of the signal in the adjacent block region; and said controller being configured to determine an expected status of each of one or more of the signals to be experienced by the powered system in the plurality of block regions, based upon the time duration and at least one route parameter of one or more of the plurality of block regions;

wherein the controller includes a memory configured to store the at least one route parameter of the one or more of the plurality of block regions;

wherein said memory is further configured to store a characteristic of a leading powered system traveling on the route in said adjacent block region; and said controller is configured to determine an expected movement of the leading powered system in a plurality of block regions subsequent to the adjacent block region based upon said stored characteristic of the leading powered system and one or more of the at least one route parameter of said plurality of block regions;

and wherein said controller is coupled to an engine and a braking system of the powered system; and said controller is configured to selectively modify one of a power output of the engine and a level of the braking system, based on the expected status of each of the one or more signals in the plurality of block regions, so to minimize a total amount of fuel consumed by the powered system in the plurality of block regions.

17. A system for pacing a powered system traveling along a route separated into a plurality of block regions, each block region having a respective signal, the system comprising:

a controller configured to receive a status of the signal in a block region adjacent to a current block region of the powered system; said controller being configured to determine a time duration relating to a change in the status of the signal in the adjacent block region; and said controller being configured to determine an expected status of each of one or more of the signals to be experienced by the powered system in the plurality of block regions, based upon the time duration and at least one route parameter of one or more of the plurality of block regions;

wherein the controller includes a memory configured to store the at least one route parameter of the one or more of the plurality of block regions;

wherein said memory is further configured to store a characteristic of a leading powered system traveling on the route in said adjacent block region; and said controller is configured to determine an expected movement of the leading powered system in a plurality of block regions subsequent to the adjacent block region based upon said stored characteristic of the leading powered system and one or more of the at least one route parameter of said plurality of block regions;

wherein said controller is configured to determine an expected status of each of the one or more signals to be experienced by the powered system in the plurality of block regions, based on the expected movement of the leading powered system in the plurality of block regions;

and wherein said controller is configured to determine an earliest arrival time and a latest arrival time at each of the plurality of block regions based upon the expected statuses of the signals in the plurality of block regions; and said controller is coupled to an engine and a braking system to selectively modify one of a power output of the engine and a level of the braking system such that said powered system arrives at each block region within an arrival time range defined by said earliest arrival time and said latest arrival time.

* * * * *